US005743200A

United States Patent [19]

Miller et al.

[11] Patent Number: 5,743,200

[45] Date of Patent: Apr. 28, 1998

[54] APPARATUS FOR MANUFACTURING TUFTED RUGS

[75] Inventors: Richard Miller, Lookout Mountain, Tenn.; K. C. Keys, Ringgold, Ga.

[73] Assignee: Davis & Davis Custom Rugs and Broadloom, Chattanooga, Tenn.

[21] Appl. No.: 623,248

[22] Filed: Mar. 28, 1996

[51] Int. Cl.[6] ..... D05B 3/00; D05C 15/30

[52] U.S. Cl. ..... 112/80.01; 112/80.41; 112/221; 112/470.13

[58] Field of Search ..... 112/79, 80.01, 112/80.41, 98, 117, 220, 221, 258, 470.12, 470.13, 470.14

[56] References Cited

U.S. PATENT DOCUMENTS

| | | | |
|---|---|---|---|
| 2,078,258 | 4/1937 | Lundgren | 112/80 |
| 2,533,420 | 12/1950 | Blumfield | 112/80 |
| 2,534,916 | 12/1950 | King | 112/80 |
| 2,682,842 | 7/1954 | Salle | 112/79 |
| 3,450,076 | 6/1969 | Bender | 112/473.13 X |
| 3,515,080 | 6/1970 | Tamsey | 112/470.13 |
| 3,765,349 | 10/1973 | Gerber | 112/470.13 |
| 3,977,336 | 8/1976 | Gauslow | 112/80 |
| 4,669,406 | 6/1987 | Muroya . | |
| 5,090,341 | 2/1992 | Satterfield | 112/80.04 |
| 5,503,092 | 4/1996 | Aubourg et al. | 112/470.13 X |
| 5,540,165 | 7/1996 | Katou et al. | 112/470.13 |
| 5,543,005 | 8/1996 | Monget et al. | 112/470.12 X |

FOREIGN PATENT DOCUMENTS

| | | | |
|---|---|---|---|
| 2215744 | 9/1989 | United Kingdom | 112/80.03 |

OTHER PUBLICATIONS

Wilcom Graphic Applications, Greensboro, NC, "Auto–Tuft System Data Sheet", (Mar. 1994).

Wilcom Worldwide, Greensboro, NC, "Wilcom Tufting Models TM2417 & TS500".

*Primary Examiner*—Paul C. Lewis

*Attorney, Agent, or Firm*—Pitts & Brittian, P.C.

[57] ABSTRACT

An apparatus (10) is provided for tufting an embroidered rug using an automated tufting machine and an X-Y gantry, wherein the tufting needle to rotate without creating adverse affects in the tufted pattern. A tufting head (42) is carried by an upper gantry (12) and is moveable along the length thereof in the Y-direction via a tufting head motor (66). The upper gantry (12) and a lower gantry (30) are moveable in the X-direction via two upper gantry motors (20). The tufting head (42) includes a cylinder (46), a piston (50), a needle (52), and a blade (54). The cylinder (46) is secured to a frame (44) via at least one pillow block (58) defining a cylindrical opening (60) dimensioned to slidably receive the cylinder (46). The piston (50) carries the blade (54) and is configured to reciprocate within the cylinder (46). The needle (52) is secured to the distal end of the cylinder (46) and defines a centrally disposed through opening (53). The blade (54) is coaxial with the longitudinal axis of the cylinder (46). A motor (70) is provided for imparting rotation on a drive gear (74) and a secondary gear (78), which are provided for reciprocating the cylinder (46) and piston (50), respectively. A motor (92) is provided for rotating the cylinder (46), piston (50), needle (52) and blade (54) about the Z-axis. Each of the motors (20, 66, 70, 92) is controlled using a conventional computer.

15 Claims, 5 Drawing Sheets

APPARATUS FOR MANUFACTURING TUFTED RUGS

TECHNICAL FIELD

This invention relates to the field of tufted rugs. More specifically, this invention relates to an apparatus for manufacturing tufted rugs having an ornamental design tufted therein.

BACKGROUND ART

In the field of tufting, it is well known that ornamental rugs are typically manufactured using hand-held tufting devices. Although conventional tufting machines designed for manufacturing carpet are capable of producing carpets having selected patterns, they are limited in this endeavor. Specifically, conventional tufting machines include at least one needle bar, and typically two, carrying a row of needles. Each needle is threaded with a filament to be used in tufting the carpet. With each tuft, the needle bars may move laterally with respect to each other and with respect to the carpet backing. Further, the length of the pile may be altered by using varying configurations of hooks to gather the individual stitches once punched through the backing material. Further, if desired, the individual piles may be cut or left as loops, again depending upon the individual hooks selected to engage the loops as they are received through the backing material. However, what cannot be varied is the pattern in which the yams or filaments are tufted. In these conventional carpet tufting machines, each filament defines one tuft in each row of tufts, although one tuft may be shifted a number of steps to the left or right of the previous tuft. Thus, patterns are created by shifting the needles bars with respect to each other and the backing material, by cutting selected loops, or by varying the pile height so as to hide some piles beneath adjacent piles. Although the needle bars may be shifted laterally with respect to each other and the backing material, movement of the needles bars in the direction of the backing material is substantially prohibited while the backing material movement is unidirectional.

In view of the inability of conventional tufting machines to produce intricate ornamental rugs, several hand-held device have been produced to tuft ornamental rugs. Typical of the art are those devices disclosed in the following U.S. Pat. Nos.:

| Pat. No. | Inventor(s) | Issue Date |
|---|---|---|
| 2,078,258 | F.J. Lundgren | Apr. 27, 1937 |
| 2,533,420 | J. Blumfield | Dec. 12, 1950 |
| 2,534,916 | E. King | Dec. 19, 1950 |
| 2,682,842 | M. Salle | July 6, 1954 |
| 3,977,336 | L.K. Gauslow | Aug. 31, 1976 |
| 5,090,341 | W.H. Satterfield | Feb. 25, 1992 |

However, it is well known that hand-held devices such as those disclosed in these patents are time-consuming to operate. Because they are manually operated, it is also known that errors are more likely than with rugs manufactured using automated machines. Further, it is also known that the operators of such devices are subject to repetitive task injuries due to extended use.

In order to overcome the inefficiencies of hand-held devices, devices such as that disclosed by T. Muroya in U.S. Pat. No. 4,669,406, issued on Jun. 2, 1987, have been provided. These devices incorporate an X-Y table on which a frame is placed, the frame having a backing material secured thereto. A tufting device is carried by the frame for tufting the rug or carpet. The tufting device is typically controlled automatically. Other devices similar to the '406 apparatus is the TM2417 tufting machine and controller manufactured by Wilcom Tufting, 7031 Albert Pick Road, Suite 101, Greensboro, N.C., 27409.

It is well known that typical tufting devices employ needles having a blade which reciprocates therein. The blade pushes the filament through the backing material in order to fabricate the rug. However, the point of the blade is typically off-center from the needle. Further, the needle operates in a fixed orientation. Because the needle is fixed and the blade is off-center, when the tufting device is moved in an angular pattern (i.e., in both the X- and Y-directions simultaneously) creating a tuft in a specific location is made difficult. Specifically, the offset distance form the center of the needle must be taken into account for each individual tuft.

Therefore, it is an object of this invention to provide an improved tufting device for tufting an embroidered rug using an automated tufting machine and an X-Y gantry.

Another object of the present invention is to provide a means whereby the blade of the needle is centered in the needle in which it reciprocates.

A further object of the present invention is to provide such a tufting device whereby the needle is rotatable such that the leading edge of the needle is continuously facing the direction of travel of the tufting device.

DISCLOSURE OF THE INVENTION

Other objects and advantages will be accomplished by the present invention which is provided for tufting an embroidered rug using an automated tufting machine and an X-Y gantry, wherein the tufting needle rotates without creating adverse affects in the tufted pattern as a result of the insertion point of the blade being off-center with respect to the needle. A tufting head is provided for tufting an embroidered pattern into a backing material. The tufting head is carried by an upper gantry and is moveable along the length thereof. The tufting head is carried by a belt member tensioned around two tufting head pulleys. A motor is provided for rotating one of the tufting head pulleys, thus, as the motor is operated, the tufting head is moved tangentially along the path of the tufting head belt along the X-axis.

The upper gantry is disposed above and parallel to a lower gantry. In similar fashion to the tufting head, in the preferred embodiment, each end of the upper gantry is carried by one of two upper gantry belt members, each being tensioned around two upper gantry pulleys. A motor is provided for rotating one of the upper gantry pulleys, the output shaft of the motor being secured to the center of the particular upper gantry pulley. As the motor is operated, the respective end of the upper gantry is moved along the Y-axis.

The lower gantry includes two spaced apart linear members for supporting the backing material as the ornamental embroidery is being performed thereon by the tufting head. The linear members are positioned with respect to each other such that the tufting needle blade passes therebetween while at its lowest point during a tuft, and further such that the backing material experiences minimal deflection as a result of the pressure of the tufting head as the blade forces a filament through an opening in the backing material. Each linear member is comprised of a series of rollers pivotally mounted above a linear plate.

The lower gantry is secured at either end to one of two lower gantry belt members. Each lower gantry belt member is tensioned between two pulleys such that as one pulley is rotated, the lower gantry belt member is driven in a circuit in a corresponding direction. Accordingly, as the lower gantry belt members are driven, each end of the lower gantry is moved. The distal end of the output shaft of the upper gantry motor carries a pulley for driving a timing belt. The timing belt then imparts rotation on another timing belt pulley which is secured coaxially to one of the pulleys provided for tensioning and imparting movement on the respective lower gantry belt.

A frame is provided for securing the tufting head to the upper gantry, the tufting head generally comprising a cylinder, a piston, a needle, and a blade. The cylinder is secured to the frame via at least one pillow block defining a cylindrical opening dimensioned to slidably receive the cylinder. The piston carries the blade and is configured to reciprocate within the cylinder. The needle is secured to the distal end of the cylinder and defines a centrally disposed through opening. As the piston is reciprocated within the cylinder, the blade is projected from and retracted into the needle. The blade is positioned within the needle such that the blade is coaxial with the longitudinal axis of the cylinder.

A motor is provided for imparting the motions of both the cylinder and the piston. The output shaft of the motor is coaxially secured to a drive gear, to which is secured a cam. The cam is carried eccentrically by the drive gear. The cam is received by a receptor defined by a slide associated with the cylinder. A collar is secured to the cylinder and is received by the slide to allow rotation about the Z-axis within the slide. The receptor is configured to receive the cam in such a manner as to impart movement along the Z-axis as the motor is operated. A slotted opening is defined by the cylinder to expose the proximal end of the piston. A secondary gear cooperating with and driven by the drive gear is pivotally carried by the frame and carries a cam as described above. The secondary cam is received by a receptor in a piston slide similar to the cylinder slide described above. A piston collar is secured to the piston through the slotted opening, the slotted opening having terminal ends spaced apart a distance greater than the travel distance of the piston. The piston is prevented from axial rotation with respect to the cylinder due to the attachment of the piston collar to the piston through the slotted opening. The piston slide receives the piston collar in similar fashion as the cylinder slide and collar.

A motor is provided for rotating the cylinder, piston, needle and blade about the Z-axis. The motor is secured to the proximal end of the cylinder, or may be associated with the cylinder via a reducer. Rotation of the motor output shaft results in the rotation of the cylinder within the pillow blocks, the rotation of the cylinder collar within the cylinder slide, and rotation of the piston collar within the piston slide. Due to the fixed relationship between the piston and the cylinder, that between the needle and the cylinder, and that between the blade and the piston, it will seen that as one such component is rotated, each component is rotated.

Each of the motors are controllable using a conventional computer. In such an application, the desired pattern to be tufted is input to the computer. Output from the computer is used to control the upper gantry motors, the tufting head motor, the motor used to reciprocate the needle and blade, and the motor used to pivot the needle and blade. Thus, the selected pattern is precisely controlled.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An apparatus for manufacturing tufted rugs incorporating various features of the present invention is illustrated generally at 10 in the figures. The apparatus for manufacturing trifled rugs, or apparatus 10 is designed for tufting an embroidered rug using an automated tufting machine and an X-Y gantry. Moreover, in the preferred embodiment the apparatus 10 is designed to allow the tufting needle to rotate without creating adverse affects in the tufted pattern, which is a result of the insertion point of the needle blade being off-center with respect to the needle in conventional tufting heads.

Figure 1:
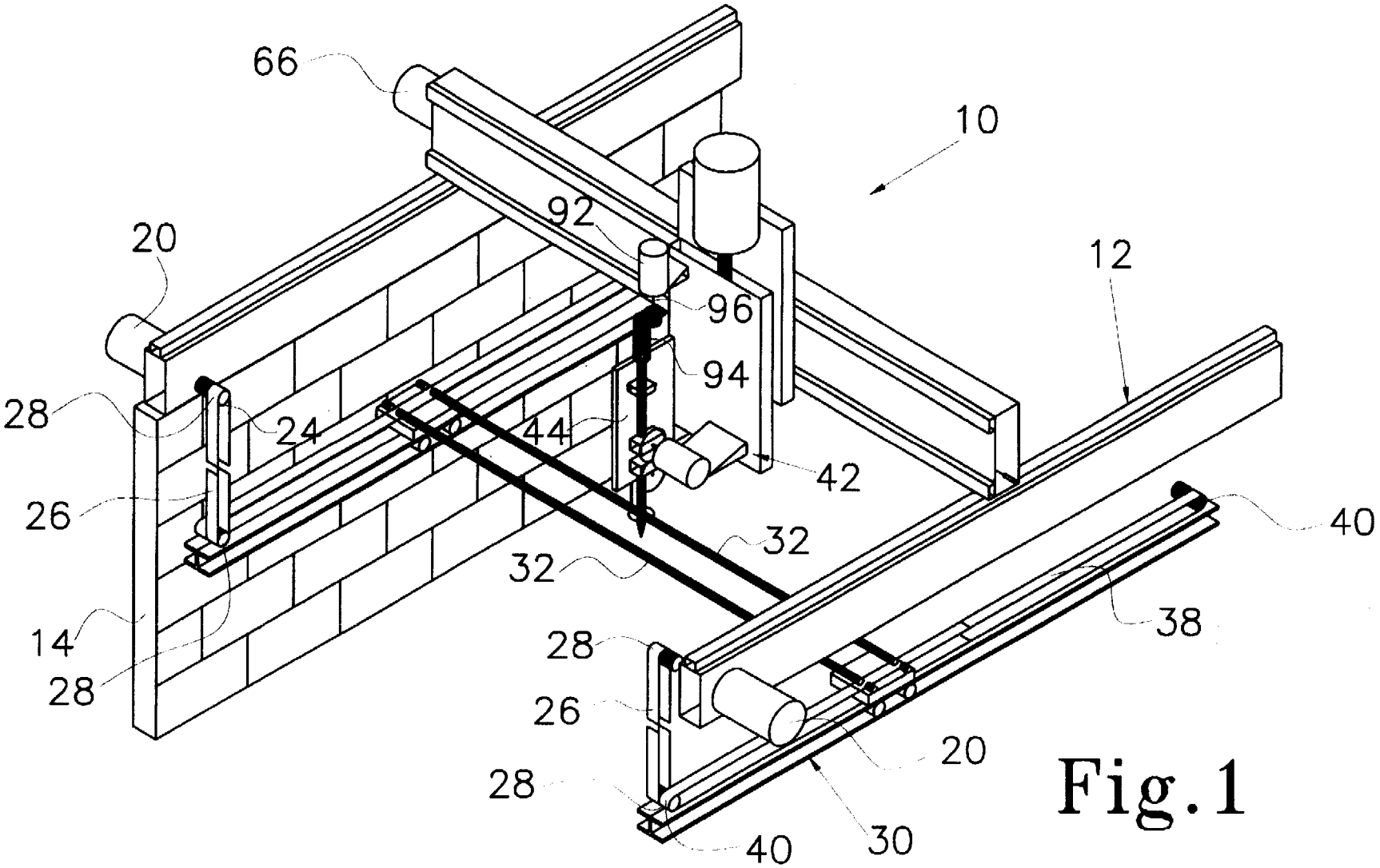
FIG. 1 is a perspective view of the apparatus for manufacturing tufted rugs constructed in accordance with several features of the present invention.
Figure 2:
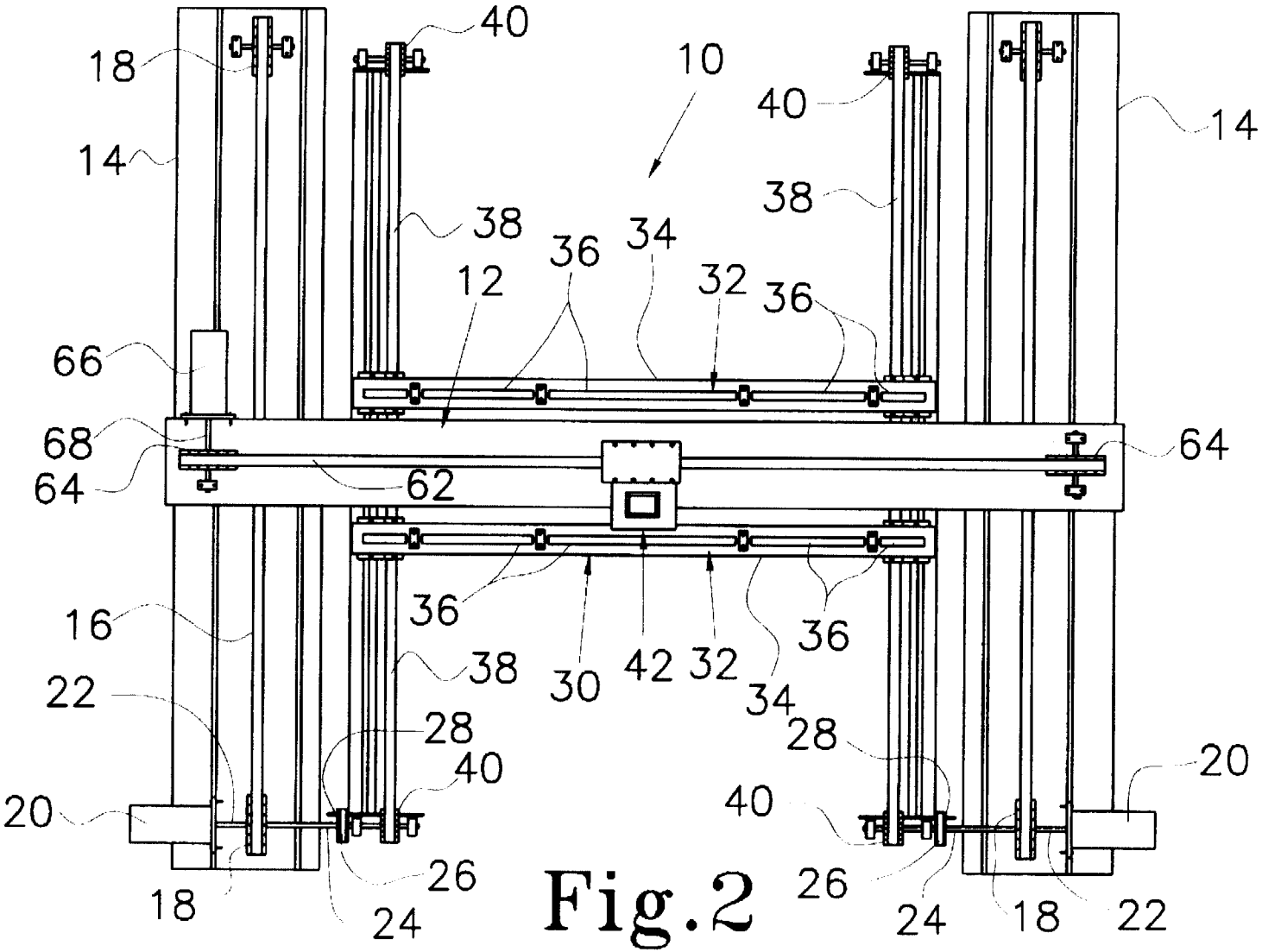
FIG. 2 is a top plan view of the apparatus for manufacturing tufted rugs of the present invention.
Figure 3:
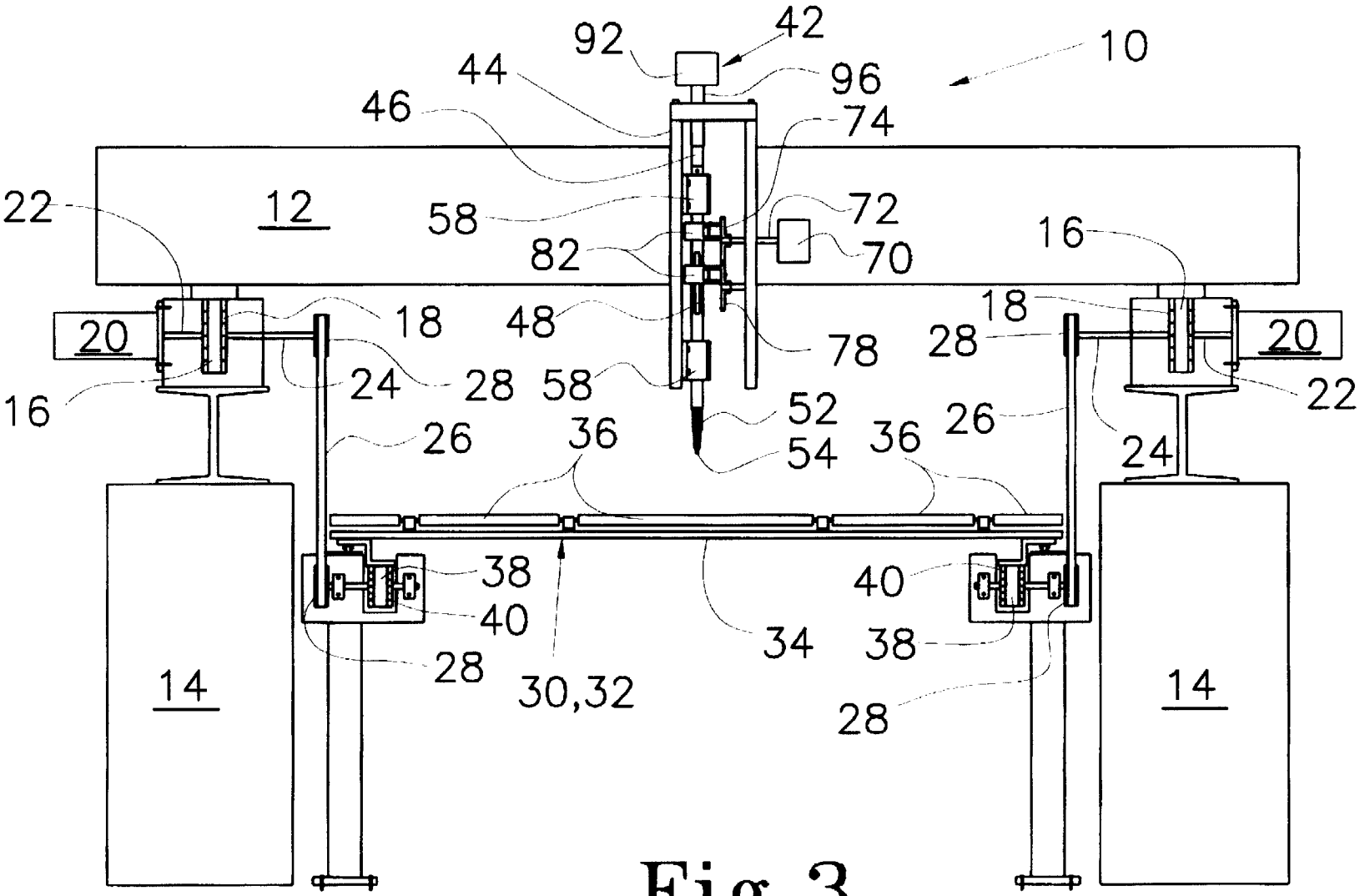
FIG. 3 is a front elevational view of the apparatus for manufacturing tufted rugs of the present invention.

Illustrated in FIG. 1 is a perspective view of the apparatus 10 of the present invention. FIGS. 2 and 3, respectively, illustrate a top plan view and a front elevational view of the apparatus 10 of the present invention. A tufting head 42 is provided for tufting an embroidered pattern into a backing material (not shown). The tufting head 42 is carried by an upper gantry 12 and is moveable along the length thereof. In the preferred embodiment, the tufting head 42 is carried by a belt member 62 tensioned around two tufting head pulleys 64. A motor 66 is provided for rotating one of the tufting head pulleys 64, the output shaft 68 of the motor 66 being secured to the center of the particular tufting head pulley 64. The motor 66 of the preferred embodiment is a conventional servo motor capable of rotational output in stepped increments in both clockwise and counter-clockwise directions. As the motor 66 is operated, the tufting head 42 is moved tangentially along the path of the tufting head belt 62, thus in a longitudinal direction with respect to the upper gantry 12. As illustrated in FIG. 2, the tufting head 42 is moved along the upper gantry 12 along the X-axis.

The upper gantry 12 is disposed above and parallel to a lower gantry 30. The upper gantry 12 is supported at either end by one of two stationary supports 14. In similar fashion to the tufting head 42, in the preferred embodiment, each end of the upper gantry 12 is carried by one of two upper gantry belt members 16, each upper gantry belt member 16 being tensioned around two upper gantry pulleys 18. The upper gantry belt member 16 is oriented at a right angle with respect to the tufting head belt 62. A motor 20 is provided for rotating one of the upper gantry pulleys 18, the output shaft 22 of the motor 20 being secured to the center of the particular upper gantry pulley 18. As the motor 20 is operated, the respective end of the upper gantry 12 is moved tangentially along the path of the upper gantry belt 16, thus along the Y-axis of FIG. 2.

The lower gantry 30 includes at least two spaced apart linear members 32 for supporting the backing material as the ornamental embroidery is being performed thereon by the tufting head 42. The linear members 32 are positioned with respect to each other such that the tufting needle blade 54 passes therebetween while at its lowest point during a tuft, and further such that the backing material experiences minimal deflection as a result of the pressure of the tufting head 42 as the blade 54 forces a filament through an opening in the backing material. As illustrated most clearly in FIG. 3, each linear member 32 is comprised of a series of rollers 36 pivotally mounted above a linear plate 34. Each roller 36 is oriented such that as the lower gantry 30 is moved in the Y-direction, the frictional relationship between the backing material and the rollers 36 causes the rollers 36 to pivot, thereby preventing the lower gantry linear members 32 from damaging the backing material or the tufts.

The lower gantry 30 is secured at either end to one of two lower gantry belt members 38. Each lower gantry belt member 38 is tensioned between two pulleys 40 such that as one pulley 40 is rotated, the lower gantry belt member 38 is driven in a circuit in a corresponding direction. Accordingly, as the lower gantry belt members 38 are driven, each end of the lower gantry 30 is moved. To this extent, the lower gantry belt members 38 are disposed parallel to the upper gantry belt members 16 such that the movement of the lower gantry 30 is along the Y-axis. In the preferred embodiment, movement of the lower gantry 30 corresponds to movement of the upper gantry 12. And more specifically, the disposition of the lower gantry 30 is substantially fixed with respect to the upper gantry 12. To accomplish this relationship, the distal end 24 of the output shaft 22 of the motor 20 provided to drive an upper gantry belt member 16 eardes a pulley 28 for driving a timing belt 26. The timing belt 26 then imparts rotation on another timing belt pulley 28 which is secured coaxially to one of the pulleys 40 provided for tensioning and imparting movement on the respective lower gantry belt 38. The respective radii of the upper gantry pulleys 18, the timing belt pulleys 28, and the lower gantry pulleys 40 are dimensioned such that the tangential velocity of the upper gantry belt members 16 is substantially equal to the tangential velocity of the lower gantry belt members 38.

Due to the functions of conventional servo motors, it will be seen then that the tufting head 42 may be moved with respect to the backing material either left or right, and forward or rearward in selected intervals in order to tuft the selected ornamental design as a result of operating the tufting head motor 66 and the two upper gantry motors 20. The backing material in the preferred embodiment remains stationary. However, although not illustrated, it will be recognized that the backing material may be moved in the Y-direction while the tufting head 42 is moved solely in the X-direction, thus achieving substantially the same result.

Figure 4:
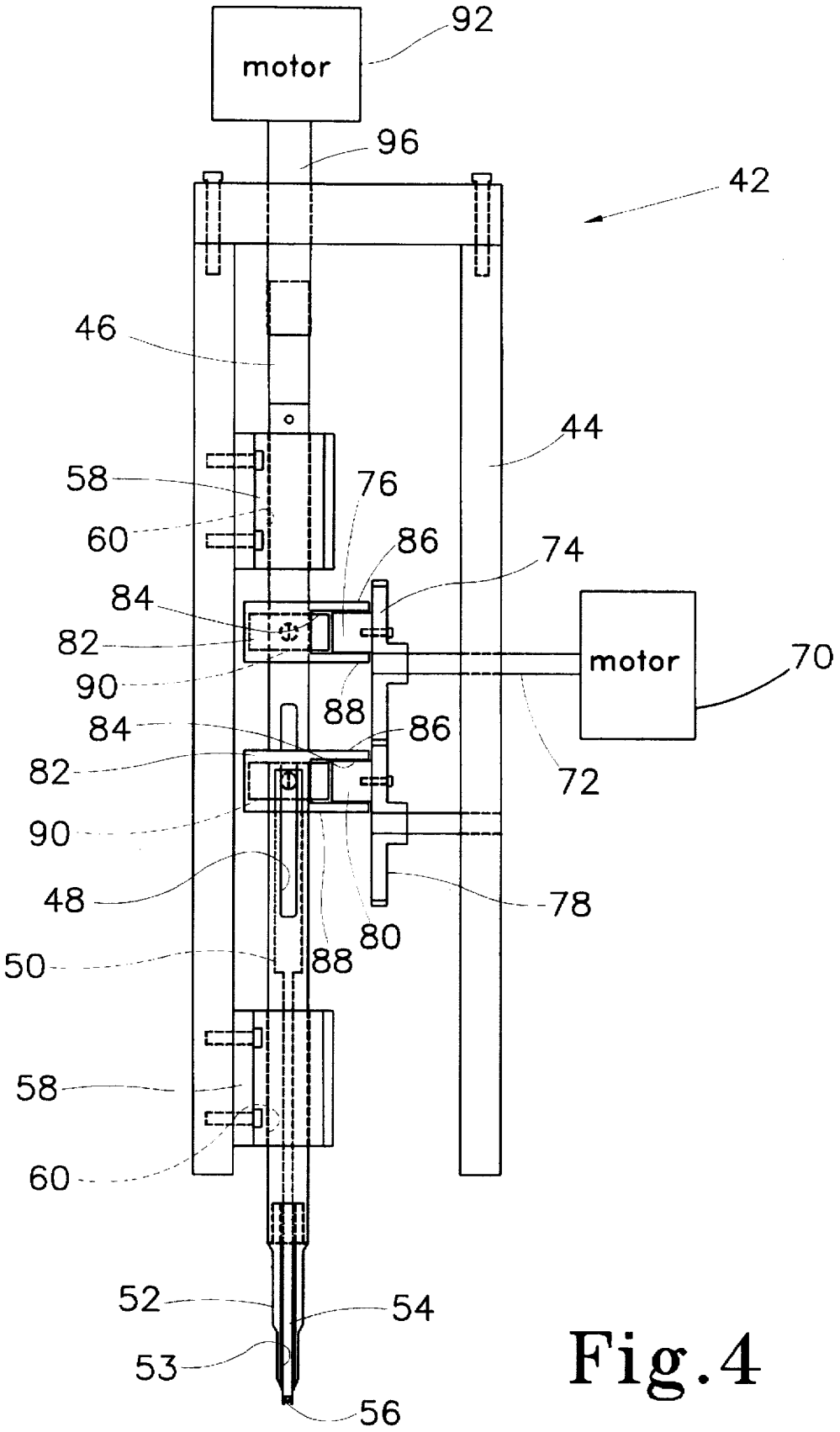
FIG. 4 illustrates an elevational view of the tufting head used in association with the present invention.
Figure 5:
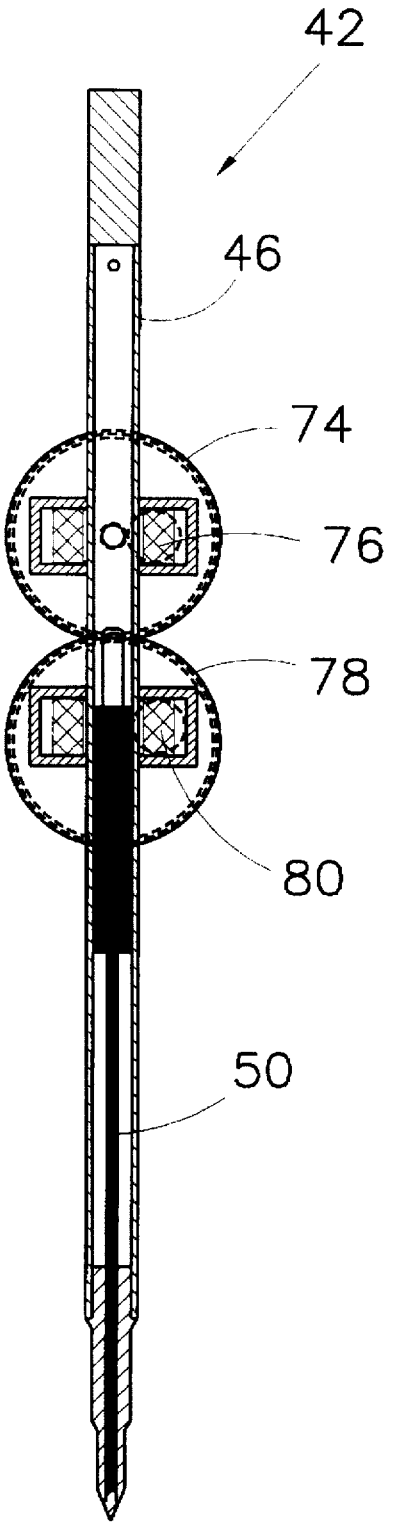
FIG. 5 illustrates an elevational view, in section, of a portion of the tufting head of the present invention showing the blade retracted within the needle.
Figure 6:
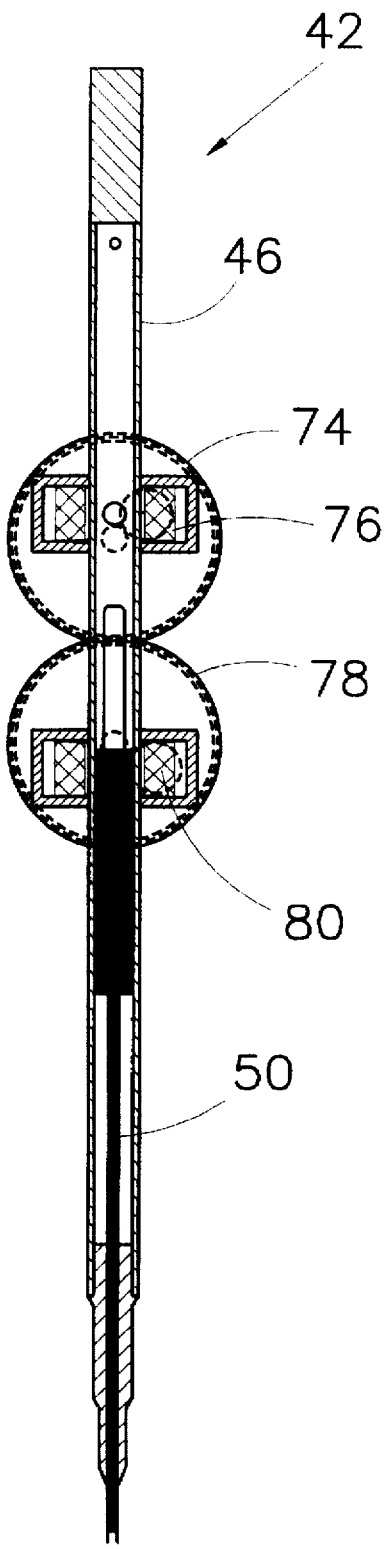
FIG. 6 illustrates an elevational view, in section, of a portion of the tufting head of the present invention showing the blade extended from the needle.

The tufting head 42 is more dearly illustrated in FIGS. 4–6. A frame 44 is provided for securing the tufting head 42 to the upper gantry 12 as illustrated in FIGS. 1–3. The tufting head 42 is generally comprised of a cylinder 46, a piston 50, a needle 52, and a blade 54. The cylinder 46 is secured to the frame 44 via at least one pillow block 58 defining a cylindrical opening 60 dimensioned to slidably receive the cylinder 46. The cylinder 46 may slide or rotate within the opening 60 defined by each of the pillow blocks 58. In order to stabilize the cylinder 46, at least two pillow blocks 58 are provided in the preferred embodiment. The piston 50 is received within the cylinder 46 and carries the blade 54. The piston 50 is configured to reciprocate within the cylinder 46. The needle 52 is secured to the distal end of the cylinder 46 and defines a centrally disposed through opening 53. Thus, as the piston 50 is reciprocated within the cylinder 46, the blade 54 is projected from and retracted into the needle 52.

The blade 54 is positioned within the needle 52 such that the blade 54 is coaxial with the longitudinal axis of the cylinder 46. By so disposing the blade 54, no correction is necessary with respect to an offset of the blade 54 with respect to the cylinder 46 when the tufting head 42 is being moved in a direction other than solely in the Y-direction.

In order to facilitate pressing a filament through the backing material, a notch 56 is defined in the distal end of the blade 54. As the blade 54 is moved downward, the filament is received within the notch 56 and then forced through the backing material. To this extent, the needle 52 and the blade 54 are both independently reciprocal with respect to the backing material. In typical operation, the needle 52 is forced through the backing material, and then the blade 54 is projected from the needle 52, pushing the filament along with it. The needle and blade 54 are then withdrawn. In order to accomplish this series of movements, the cylinder 46 and piston 50 each independently reciprocate along a vertical axis, essentially the Z-axis.

A motor 70 is provided for imparting the motions of both the cylinder 46 and the piston 50. The output shaft 72 of the motor 70 is coaxially secured to a drive gear 74, to which is secured a cam 76. The cam 76 is carried eccentrically by the drive gear 74. The cam 76 is received by a receptor 84 defined by a slide 82 associated with the cylinder 46. A collar 90 is secured to the cylinder 46 and is received by the slide 82 to allow rotation about the Z-axis within the slide 82. The receptor 84 is configured to receive the cam 76 in such a manner as to impart movement along the Z-axis as the motor 70 is operated. As illustrated, the receptor 84 includes at least an upper stop 86 and a lower stop 88 spaced apart to closely receive the cam 76. With the illustrated configuration of the cam 76, the cam 76 is pivotally secured to the drive gear 74 such that as the drive gear 74 is rotated, the cam 76 remains in substantially the same horizontal disposition. The cam 76 will undergo translational movement equal in either direction to the eccentricity of the cam 76 with respect to the drive gear 74. Specifically, if the cam 76 is offset from the center of the drive gear 74 one-half inch, then the cam 76 will travel one-half inch to the left and one-half inch to the right, in the embodiment illustrated in FIGS. 5 and 6. In this example, the total movement imparted on the cylinder 46 is one inch. Thus, the travel distance to be imparted on the needle 52 is achieved by positioning the cam 76 a distance equal to one-half that travel distance from the center of the drive gear 74. Left and right stops may be provided, so long as they are each spaced to allow this translational movement. It is envisioned that the cam 76 may be configured to define a circular cross-section, wherein the cam 76 is allowed to rotate within the receptor 84. In this embodiment, the cam 76 may thus be fixed to the drive gear 74.

A slotted opening 48 is defined by the cylinder 46 to expose the proximal end of the piston 50. A secondary gear 78 cooperating with and driven by the drive gear 74 is pivotally carried by the frame 44 and carries a cam 80 similar to that described above. The secondary cam 80 is received by a receptor 84 in a slide 82 similar to the slide 82 described above. A collar 90 is secured to the piston 50 through the slotted opening 48, the slotted opening 48 having terminal ends spaced apart sufficiently to allow for the independent reciprocation of the cylinder 46 and the piston 50. The piston 50 is prevented from axial rotation with respect to the cylinder 46 due to the attachment of the piston collar 90 to the piston 50 through the slotted opening 46. The piston slide 82 receives the piston collar 90 in similar fashion as the cylinder slide 82 and collar 90. As before, the travel distance of the piston 50 is determined as twice the offset of the secondary cam 80 from the center of the secondary gear 78.

It will be seen that the orientation of the drive gear 74 with respect to that of the secondary gear 78 may be selected such that the proper timing of the insertion of the needle 52 through the backing material, the projection of the blade 54, the retraction of the needle 52, and the retraction of the blade 54 may be accomplished in the proper sequence, and at the proper times. In the preferred embodiment, when the drive gear cam 76 reaches the bottom of its travel and begins its ascent, the secondary cam 80 is following. Then, as the drive gear cam 76 causes the needle 52 to begin rising from the backing material, the blade 54 is reaching its lowest point. After the blade 54 has again been fully retracted within the needle 52, the needle 52 is pushed through the backing material again, with the blade 54 once again following. FIG. 5 illustrates one embodiment wherein the drive gear cam 76 is midway through a stroke and the secondary cam 80 is at the top of its stroke. Thus, the secondary cam 80 follows the drive gear cam 76 by ninety degrees. In FIG. 6, the secondary cam 80 follows the drive gear cam 74 by one hundred eighty degrees, i.e., the drive gear cam 76 is at the top of its travel while the secondary cam 80 is at the bottom. By providing a motor 70, a drive gear 74, and a secondary gear 78 as described, the blade 54 is capable of being centrally located within the needle 52. As the tufting head 42 travels across the backing material, the need for correcting for an offset is thus obviated.

A motor 92 is provided for rotating the cylinder 46, piston 50, needle 52 and blade 54 about the Z-axis. The motor 92 is secured to the proximal end of the cylinder 46 as illustrated in FIG. 4 or may be associated with the cylinder 46 via a reducer 94 as illustrated in FIG. 1. In either instance, rotation of the motor output shaft 96 results in the rotation of the cylinder 46 within the pillow blocks 58, the rotation of the cylinder collar 90 within the cylinder slide 82, and rotation of the piston collar 90 within the piston slide 82. Due to the relationship between the piston 50 and the cylinder 46, that between the needle 52 and the cylinder 46, and that between the blade 54 and the piston 50, it will seen that as one such component is rotated, each component is rotated. Rotation is imparted on the cylinder 46 by operation of the motor 92 such that the blade 54 is oriented perpendicularly to the direction of travel of the tufting head 42. In so doing, the tuft is made in the center of the desired location.

Each of the motors 20, 66, 70, 92 herein described are controllable using a conventional computer (not shown). In such an application, the desired pattern to be tufted is input to the computer. Output from the computer is used to control the upper gantry motors 20, the tufting head motor 66, the motor 70 used to reciprocate the needle 52 and blade 54, and the motor 92 used to pivot the needle 52 and blade 54. Thus, it will be seen that the selected pattern is precisely controlled.

From the foregoing description, it will be recognized by those skilled in the art that an apparatus for manufacturing tufted rugs offering advantages over the prior art has been provided. Specifically, the apparatus provides a means for tufting an embroidered rug using an automated tufting machine and an X-Y gantry whereby the blade is centered in the needle in which it reciprocates. Moreover, the apparatus of the present invention provides a means whereby the blade is rotatable such that the leading edge of the blade is continuously facing the direction of travel of the tufting device.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. An apparatus for manufacturing tufted rugs, said apparatus comprising:

an upper gantry oriented along an X-axis and movable along a Y-axis;

a lower gantry oriented parallel to and below said upper gantry, said lower gantry being movable along said Y-axis; and a tufting head carried by said upper gantry and movable along said X-axis, said tufting head including:

a frame carried by said upper gantry and having at least one pillow block secured thereto, said at least one pillow block defining a through opening oriented along a Z-axis, said through opening defined by each of said at least one pillow block being coaxial one with another;

a cylinder closely received within said through opening defined by each said at least one pillow block, said cylinder being movable along and pivotally about said Z-axis, said cylinder being reciprocal toward and away from a backing material to be tufted;

a piston slidably received within said cylinder, said piston being reciprocated within said cylinder independently from reciprocation of said cylinder, said piston being prevented from axial rotation within said cylinder such that as said cylinder is rotated about said Z-axis, said piston is likewise rotated about said Z-axis;

a needle secured to a distal end of said cylinder, said needle defining a centrally-disposed through opening coaxial with said cylinder, said needle being reciprocated along said Z-axis as said cylinder is reciprocated; and a blade secured to a distal end of said piston, a longitudunal axis of said blade being coaxial with said cylinder and with said through opening defined by said needle, said blade being projected from and withdrawn into said needle as said cylinder and said piston are independently reciprocated.

2. The apparatus of claim 1 wherein said upper gantry is supported at a proximal and a distal end by one of a pair of support structures oriented along said Y-axis, each said proximal and distal end being provided with an upper gantry drive mechanism including an upper gantry motor, a plurality of upper gantry pulleys, and an upper gantry drive belt, one each of said plurality of upper gantry pulleys being disposed at each end of said one of a pair of support structures, said upper gantry drive belt being tensioned around said plurality of upper gantry pulleys, each said proximal and distal end of said upper gantry being secured to a respective said upper gantry drive belt, said upper gantry motor including an output shaft to which is secured a first of said plurality of upper gantry pulleys such that as said upper gantry motor is operated, said first of said plurality of upper gantry pulleys is rotated, thus moving said upper gantry drive belt in a circuit and moving said upper gantry, said upper gantry motor associated with each of said proximal and distal ends of said upper gantry cooperating to move said proximal and distal ends of said upper gantry at substantially the same rate and in the same direction.

3. The apparatus of claim 2 wherein said lower gantry is supported at proximal and distal ends therof respectively by said pair of support structures, each said proximal and distal end being provided with a lower gantry drive mechanism including a plurality of lower gantry pulleys, a lower gantry drive belt, a plurality of timing pulleys, and a timing belt, one each of said plurality of lower gantry pulleys being disposed at each end of said one of a pair of support structures, said lower gantry drive belt being tensioned around said plurality of lower gantry pulleys, each said proximal and distal end of said lower gantry being secured to a respective said lower gantry drive belt, a distal end of said output shaft of said upper gantry motor carrying a first of said plurality of timing pulleys, a second of said plurality of timing pulleys being secured coaxially to a first of said plurality of lower gantry pulleys, said timing belt being tensioned around said plurality of timing belt pulleys such that as said motor is operated, said first of said plurality of timing belt pulleys is rotated, thus moving said timing belt in a circuit, said timing belt thus imparting rotation on said second of said plurality of timing belt pulleys and said first of said plurality of lower gantry drive belt pulleys, thus moving a respective of said proximal and distal ends of said lower gantry.

4. The apparatus of claim 1 further comprising a tufting head reciprocating device for independently reciprocating said cylinder and said piston, said tufting head reciprocating device comprising:

a reciprocating device motor provided with an output shaft;

a drive gear secured to a distal end of said output shaft;

a drive gear cam carried eccentrically by said drive gear;

a cylinder collar secured to said cylinder;

a cylinder sleeve configured to receive said cylinder collar and to rotate thereabout, said cylinder sleeve defining a receptor for receiving said drive gear cam, said receptor limiting movement of said drive gear cam along said Z-axis such that as said drive gear cam is moved long said Z-axis, said cylinder sleeve receptor, said cylinder sleeve, said cylinder collar, and said cylinder are likewise moved along said Z-axis, said cylinder sleeve receptor allowing lateral movement of said drive cam therein;

a secondary gear carried by said frame and cooperating with said drive gear;

a secondary gear cam carried eccentrically by said secondary gear;

a piston collar secured to said piston; and a piston sleeve configured to receive said piston collar and to rotate thereabout, said piston sleeve defining a receptor for receiving said secondary gear cam, said receptor limiting movement of said secondary gear cam along said Z-axis such that as said secondary gear cam is moved long said Z-axis, said piston sleeve receptor, said piston sleeve, said piston collar, and said piston are likewise moved along said Z-axis, said piston sleeve receptor allowing lateral movement of said secondary cam therein, said cylinder being reciprocated along said Z-axis by operation of said reciprocating device motor, a displacement of said cylinder being a function of an eccentricity of said drive gear cam with respect to said drive gear, said piston being likewise reciprocated by said operation of said reciprocating device motor and through cooperation of said drive gear and said secondary gear, a displacement of said piston being a function of an eccentricity of said secondary gear cam with respect to said secondary gear, relative reciprocation of said cylinder and said piston being determined by an angular relationship between said drive gear cam and said secondary gear cam.

5. The apparatus of claim 1 further comprising a cylinder rotating mechanism including a cylinder rotating motor having an output shaft associated with a proximal end of said cylinder, said cylinder being rotating as a result of operation of said cylinder rotating motor.

6. The apparatus of claim 5 wherein said cylinder rotating mechanism further includes a reducer carried by a distal end of said cylinder rotating motor output shaft and said proximal end of said cylinder, said reducer being provided for controlling a rotational velocity of said cylinder with respect to a rotational velocity of said cylinder rotating motor output shaft.

7. The apparatus of claim 1 wherein said lower gantry includes a pair of spaced apart linear members, each of said pair of spaced apart linear members including a linear plate above which is secured a plurality of rollers in series.

8. An apparatus for manufacturing tufted rugs, said apparatus comprising:

an upper gantry oriented along an X-axis and movable along a Y-axis;

a lower gantry oriented parallel to and below said upper gantry, said lower gantry being movable along said Y-axis; and a tufting head carried by said upper gantry and movable along said X-axis, said tufting head including:

a frame carried by said upper gantry and having at least one pillow block secured thereto, said at least one pillow block defining a through opening oriented along a Z-axis, said through opening defined by each of said at least one pillow block being coaxial one with another;

a cylinder closely received within said through opening defined by each said at least one pillow block, said cylinder being movable along and pivotally about said Z-axis, said cylinder being reciprocal toward and away from a backing materiai to be tufted;

a piston slidably received within said cylinder, said piston being reciprocated within said cylinder independently from reciprocation of said cylinder, said piston being prevented from axial rotation within said cylinder such that as said cylinder is rotated about said Z-axis, said piston is likewise rotated about said Z-axis;

a needle secured to a distal end of said cylinder, said needle defining a centrally-disposed through opening coaxial with said cylinder, said needle being reciprocated along said Z-axis as said cylinder is reciprocated; and a blade secured to a distal end of said piston, a longitudunal axis of said blade being coaxial with said cylinder and with said through opening defined by said needle, said blade being projected from and withdrawn into said needle as said cylinder and said piston are independently reciprocated;

a tufting head reciprocating device for independently reciprocating said cylinder and said piston, said tufting head reciprocating device comprising:

a reciprocating device motor provided with an output shaft;

a drive gear secured to a distal end of said output shaft;

a drive gear cam carried eccentrically by said drive gear;

a cylinder collar secured to said cylinder;

a cylinder sleeve configured to receive said cylinder collar and to rotate thereabout, said cylinder sleeve defining a receptor for receiving said drive gear cam, said receptor limiting movement of said drive gear cam along said Z-axis such that as said drive gear cam is moved long said Z-axis, said cylinder sleeve receptor, said cylinder sleeve, said cylinder collar, and said cylinder are likewise moved along said Z-axis, said cylinder sleeve receptor allowing lateral movement of said drive cam therein;

a secondary gear carried by said frame and cooperating, with said drive gear;

a secondary gear cam carried eccentrically by said secondary gear;

a piston collar secured to said piston; and a piston sleeve configured to receive said piston collar and to rotate thereabout, said piston sleeve defining a receptor for receiving said secondary gear cam, said receptor limiting movement of said secondary gear cam along said Z-axis such that as said secondary gear cam is moved long said Z-axis, said piston sleeve receptor, said piston sleeve, said piston collar, and said piston are likewise moved along said Z-axis, said piston sleeve receptor allowing lateral movement of said secondary cam therein, said cylinder being reciprocated along said Z-axis by operation of said reciprocating device motor, a displacement of said cylinder being a function of an eccentricity of said drive gear cam with respect to said drive gear, said piston being likewise reciprocated by said operation of said reciprocating device motor and through cooperation of said drive gear and said secondary gear, a displacement of said piston being a function of an eccentricity of said secondary gear cam with respect to said secondary gear, relative reciprocation of said cylinder and said piston being determined by an angular relationship between said drive gear cam and said secondary gear cam; and a cylinder rotating mechanism including a cylinder rotating motor having an output shaft associated with a proximal end of said cylinder, said cylinder being rotating as a result of operation of said cylinder rotating motor.

9. The apparatus of claim 8 wherein said upper gantry is supported at a proximal and a distal end by one of a pair of support structures oriented along said Y-axis, each said proximal and distal end being provided with an upper gantry drive mechanism including an upper gantry motor, a plurality of upper gantry pulleys, and an upper gantry drive belt, one each of said plurality of upper gantry pulleys being disposed at each end of said one of a pair of support structures, said upper gantry drive belt being tensioned around said plurality of upper gantry pulleys, each said proximal and distal end of said upper gantry being secured to a respective said upper gantry drive belt, said upper gantry motor including an output shaft to which is secured a first of said plurality of upper gantry pulleys such that as said upper gantry motor is operated, said first of said plurality of upper gantry pulleys is rotated, thus moving said upper gantry drive belt in a circuit and moving said upper gantry, said upper gantry motor associated with each of said proximal and distal ends of said upper gantry cooperating to move said proximal and distal ends of said upper gantry at substantially the same rate and in the same direction.

10. The apparatus of claim 9 wherein said lower gantry is supported at proximal and distal ends therof respectively by said pair of support structures, each said proximal and distal end being provided with a lower gantry drive mechanism including a plurality of lower gantry pulleys, a lower gantry drive belt, a plurality of timing pulleys, and a timing belt, one each of said plurality of lower gantry pulleys being disposed at each end of said one of a pair of support structures, said lower gantry drive belt being tensioned around said plurality of lower gantry pulleys, each said proximal and distal end of said lower gantry being secured to a respective said lower gantry drive belt, a distal end of said output shaft of said upper gantry motor carrying a first of said plurality of timing pulleys, a second of said plurality of timing pulleys being secured coaxially to a first of said plurality of lower gantry pulleys, said timing belt being tensioned around said plurality of timing belt pulleys such that as said motor is operated, said first of said plurality of timing belt pulleys is rotated, thus moving said timing belt in a circuit, said timing belt thus imparting rotation on said second of said plurality of timing belt pulleys and said first of said plurality of lower gantry drive belt pulleys, thus moving a respective of said proximal and distal ends of said lower gantry.

11. The apparatus of claim 8 wherein said cylinder rotating mechanism further includes a reducer carried by a distal end of said cylinder rotating motor output shaft and said proximal end of said cylinder, said reducer being provided for controlling a rotational velocity of said cylinder with respect to a rotational velocity of said cylinder rotating motor output shaft.

12. The apparatus of claim 8 wherein said lower gantry includes a pair of spaced apart linear members, each of said pair of spaced apart linear members including a linear plate above which is secured a plurality of rollers in series.

13. An apparatus for manufacturing tufted rugs, said apparatus comprising:

an upper gantry oriented along an X-axis and movable along a Y-axis, said upper gantry being supported at a proximal and a distal end by one of a pair of support structures oriented along said Y-axis, each said proximal and distal end being provided with an upper gantry drive mechanism including an upper gantry motor, a plurality of upper gantry pulleys, and an upper gantry drive belt, one each of said plurality of upper gantry pulleys being disposed at each end of said one of a pair of support structures, said upper gantry drive belt being tensioned around said plurality of upper gantry pulleys, each said proximal and distal end of said upper gantry being secured to a respective said upper gantry drive belt, said upper gantry motor including an output shaft to which is secured a first of said plurality of upper gantry pulleys such that as said upper gantry motor is operated, said first of said plurality of upper gantry pulleys is rotated, thus moving said upper gantry drive belt in a circuit and moving said upper gantry, said upper gantry motor associated with each of said proximal and distal ends of said upper gantry cooperating to move said proximal and distal ends of said upper gantry at substantially the same rate and in the same direction;

a lower gantry oriented parallel to and below said upper gantry, said lower gantry being movable along said Y-axis, said lower gantry being supported at proximal and distal ends therof respectively by said pair of support structures, each said proximal and distal end being provided with a lower gantry drive mechanism including a plurality of lower gantry pulleys, a lower gantry drive belt, a plurality of timing pulleys, and a timing belt, one each of said plurality of lower gantry pulleys being disposed at each end of said one of a pair of support structures, said lower gantry drive belt being tensioned around said plurality of lower gantry pulleys, each said proximal and distal end of said lower gantry being secured to a respective said lower gantry drive belt, a distal end of said output shaft of said upper gantry motor carrying a first of said plurality of timing pulleys, a second of said plurality of timing pulleys being secured coaxially to a first of said plurality of lower gantry pulleys, said timing belt being tensioned around said plurality of timing belt pulleys such that as said motor is operated, said first of said plurality of timing belt pulleys is rotated, thus moving said timing belt in a circuit, said timing belt thus imparting rotation on said second of said plurality of timing belt pulleys and said first of said plurality of lower gantry drive belt pulleys, thus moving a respective of said proximal and distal ends of said lower gantry; and a tufting head carried by said upper gantry and movable along said X-axis, said tufting head including:

a frame carried by said upper gantry and having at least one pillow block secured thereto, said at least one pillow block defining a through opening oriented along a Z-axis, said through opening defined by each of said at least one pillow block being coaxial one with another;

a cylinder closely received within said through opening defined by each said at least one pillow block, said cylinder being movable along and pivotally about said Z-axis, said cylinder being reciprocal toward and away from a backing material to be tufted;

a piston slidably received within said cylinder, said piston being reciprocated within said cylinder independently from reciprocation of said cylinder, said piston being prevented from axial rotation within said cylinder such that as said cylinder is rotated about said Z-axis, said piston is likewise rotated about said Z-axis;

a needle secured to a distal end of said cylinder, said needle defining a centrally-disposed through opening coaxial with said cylinder, said needle being reciprocated along said Z-axis as said cylinder is reciprocated; and a blade secured to a distal end of said piston, a longitudunal axis of said blade being coaxial with said cylinder and with said through opening defined by said needle, said blade being projected from and with&am into said needle as said cylinder and said piston are independently reciprocated;

a tufting head reciprocating device for independently reciprocating said cylinder and said piston, said tufting head reciprocating device comprising:

a reciprocating device motor provided with an output shaft;

a drive gear secured to a distal end of said output shaft;

a drive gear cam carried eccentrically by said drive gear;

a cylinder collar secured to said cylinder;

a cylinder sleeve configured to receive said cylinder collar and to rotate thereabout, said cylinder sleeve defining a receptor for receiving said drive gear cam, said receptor limiting movement of said drive gear cam along said Z-axis such that as said drive gear cam is moved long said Z-axis, said cylinder sleeve receptor, said cylinder sleeve, said cylinder collar, and said cylinder are likewise moved along said Z-axis, said cylinder sleeve receptor allowing lateral movement of said drive cam therein;

a secondary gear carried by said flame and cooperating with said drive gear;

a secondary gear cam carried eccentrically by said secondary gear;

a piston collar secured to said piston; and a piston sleeve configured to receive said piston collar and to rotate thereabout, said piston sleeve defining a receptor for receiving said secondary gear cam, said receptor limiting movement of said secondary gear cam along said Z-axis such that as said secondary gear cam is moved long said Z-axis, said piston sleeve receptor, said piston sleeve, said piston collar, and said piston are likewise moved along said Z-axis, said piston sleeve receptor allowing lateral movement of said secondary cam therein, said cylinder being reciprocated along said Z-axis by operation of said reciprocating device motor, a displacement of said cylinder being a function of an eccentricity of said drive gear cam with respect to said drive gear, said piston being likewise reciprocated by said operation of said reciprocating device motor and through cooperation of said drive gear and said secondary gear, a displacement of said piston being a function of an eccentricity of said secondary gear cam with respect to said secondary gear, relative reciprocation of said cylinder and said piston being determined by an angular relationship between said drive gear cam and said secondary gear cam; and a cylinder rotating mechanism including a cylinder rotating motor having an output shaft associated with a proximal end of said cylinder, said cylinder being rotating as a result of operation of said cylinder rotating motor.

14. The apparatus of claim 13 wherein said cylinder rotating mechanism further includes a reducer carried by a distal end of said cylinder rotating motor output shaft and said proximal end of said cylinder, said reducer being provided for controlling a rotational velocity of said cylinder with respect to a rotational velocity of said cylinder rotating motor output shaft.

15. The apparatus of claim 13 wherein said lower gantry includes a pair of spaced apart linear members, each of said pair of spaced apart linear members including a linear plate above which is secured a plurality of rollers in series.

* * * * *